US005146233A

United States Patent [19]

Ursenbach

[11] Patent Number: 5,146,233

[45] Date of Patent: Sep. 8, 1992

[54] ROTATING ANTENNA WITH DIPOLES FOR HF WAVES

[75] Inventor: Francois Ursenbach, Eaubonne, France

[73] Assignee: Thomson-CSF, Puteaux, France

[21] Appl. No.: 533,793

[22] Filed: Jun. 6, 1990

[30] Foreign Application Priority Data

Jun. 13, 1989 [FR] France ..... 89 07786

[51] Int. Cl.[5] ..... H01Q 3/02; H01Q 21/12

[52] U.S. Cl. ..... 343/815; 343/817; 343/882; 343/890

[58] Field of Search ..... 343/757, 812, 813, 815, 343/817, 818, 882, 890, 891

[56] References Cited

U.S. PATENT DOCUMENTS

| | | | |
|---|---|---|---|
| 2,429,653 | 10/1947 | Touraton | 343/815 |
| 2,558,727 | 7/1951 | Bernet | 343/815 |
| 2,577,469 | 12/1951 | Kumpf | 343/813 |
| 2,870,443 | 1/1959 | Lynch et al. | 343/812 |
| 3,165,817 | 1/1965 | Teague | 343/817 |
| 4,780,725 | 10/1988 | Ursenbach | 343/816 |

FOREIGN PATENT DOCUMENTS

| | | | |
|---|---|---|---|
| 2233 | 6/1979 | European Pat. Off. . | |
| 2620575 | 3/1989 | France . | |
| 256371 | 8/1948 | Switzerland | 343/813 |
| 763870 | 12/1956 | United Kingdom | 343/812 |

OTHER PUBLICATIONS

AP-S International Symposium 1988, Antennas and Propagation, vol. II, pp. 816–819, Kawakami et al.: "Metal-Bar supported full-wave dipole antennas (four-bay) with screen-type reflector plate."

*Primary Examiner*—Michael C. Wimer

*Attorney, Agent, or Firm*—Oblon, Spivak, McClelland, Maier & Neustadt

[57] ABSTRACT

The antenna has a support with a metallic structure and cables. In order to give the antenna good resistance to wind, it is made by means of rigid half-wave dipoles and these dipoles are mounted directly on the mechanical structure.

5 Claims, 3 Drawing Sheets

ROTATING ANTENNA WITH DIPOLES FOR HF WAVES

BACKGROUND OF THE INVENTION

1. Field of the Invention

The present invention pertains to antennas having a rotating support on which there is mounted at least one vertical array of radiating dipoles and at least one vertical reflector formed by wires.

2. Description of the Prior Art

Antennas such as these are known and are used in the field of HF waves. In the case of two arrays of dipoles, these antennas most usually have only one feeder line which generally goes through the support and feeds either of the two arrays by means of a switch-over unit.

The azimuthal angle of aim of prior art antennas can be easily adjusted in any direction by rotating the support. The angle of aim in elevation and the configuration of the antenna can be adjusted by means of switch-over devices enabling the connection, as desired, of all or a part of the dipoles of one and the same array of dipoles.

In these known antennas, the arrays of dipoles are formed by full wave conductive wire dipoles formed by conductive wires held between supporting beams by arrangements of cables, insulators, counterweights, pulleys etc. Thus, the dipoles are arranged in a sort of stretched curtain, in a vertical plane, between the supporting beams.

This curtain, which comprises the dipoles of an array, has a space factor that is greater than the overall dimensions of all the dipoles of the array. Under the effect of the wind, the curtain gets deformed causing, in particular, variations in input impedance of the antenna and mechanical problems. The result thereof is that the known rotating antennas are unusable at wind speeds starting from levels that are always far smaller than the maximum speed for which the stability of the antenna is ensured. This curtain which is used for the positioning of the dipoles also has other drawbacks: it is subjected to heavy stresses from the loads formed by deposits of ice. It makes it difficult to carry out the operations of hoisting or lowering the rotational antenna as well as servicing operations in the curtain.

As for the reflective curtain or curtains of known rotating antennas, they are generally constituted by a single sheet formed by horizontal wires and catenaries, and this sheet is held only by the top and by the bottom. Here too, climatic conditions give rise to deformations which can harm the working of the antenna.

SUMMARY OF THE INVENTION

The present invention is aimed at preventing these drawbacks or, at least, at reducing them. This is obtained, in particular, by a different choice of the type of dipoles used and by a different way of positioning these dipoles.

According to the invention, there is provided a rotating antenna for HF waves, having a rotating support that comprises a metallic structure and cables, n, where n is a positive integer, arrays of rigid, half-wave dipoles directly fixed to the structure and, at most, n vertical plane reflectors, formed by horizontal wires, each associated with at least one of the n arrays.

BRIEF DESCRIPTION OF THE DRAWINGS

The present invention will be understood more clearly and other characteristics will appear from the following description and from the figures pertaining thereto, of which.

MORE DETAILED DESCRIPTION

In the different figures, the corresponding elements are designated by the same references.

The rotating antenna that shall be described hereinafter comprises two arrays of half-wave dipoles, namely dipoles formed by two quarter-wave strands, and a set of switches to connect either of the two arrays to the supply of the antenna. Depending on the array connected, the antenna is a lower-range 4/4/0.5- 6/7/9/11 MHz antenna or a higher-range 4/4/0.75-13/15/17/21/26 MHz antenna. It is recalled that, according to the international electrical definition of antennas, for example the designation 4/4/0.5-6/7/9/11 MHz corresponds to an antenna designed to work in the 6, 7, 9 and 11 MHz bands (giving approximately one half wavelength of 18 m at the working center frequency of 7.7 MHz) and having four groups of four superimposed half-wave dipoles, the difference between the two groups being equal to the half wavelength at the working center frequency and the lowest group being at a distance from the ground equal to 0.5 times this wavelength.

Figure 1:
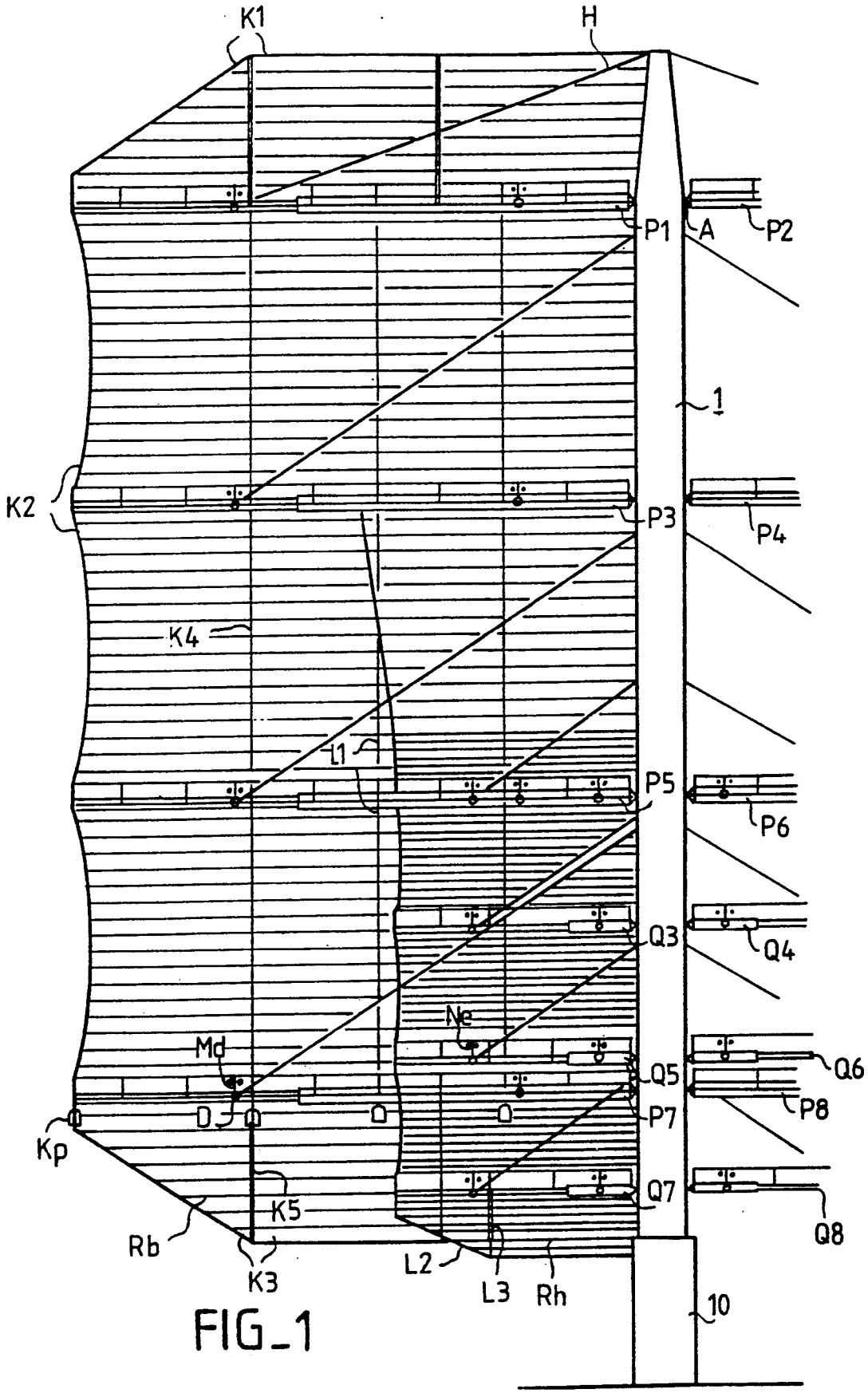
FIG. 1 shows a partial front view of a rotating antenna according to the invention.
Figure 2:
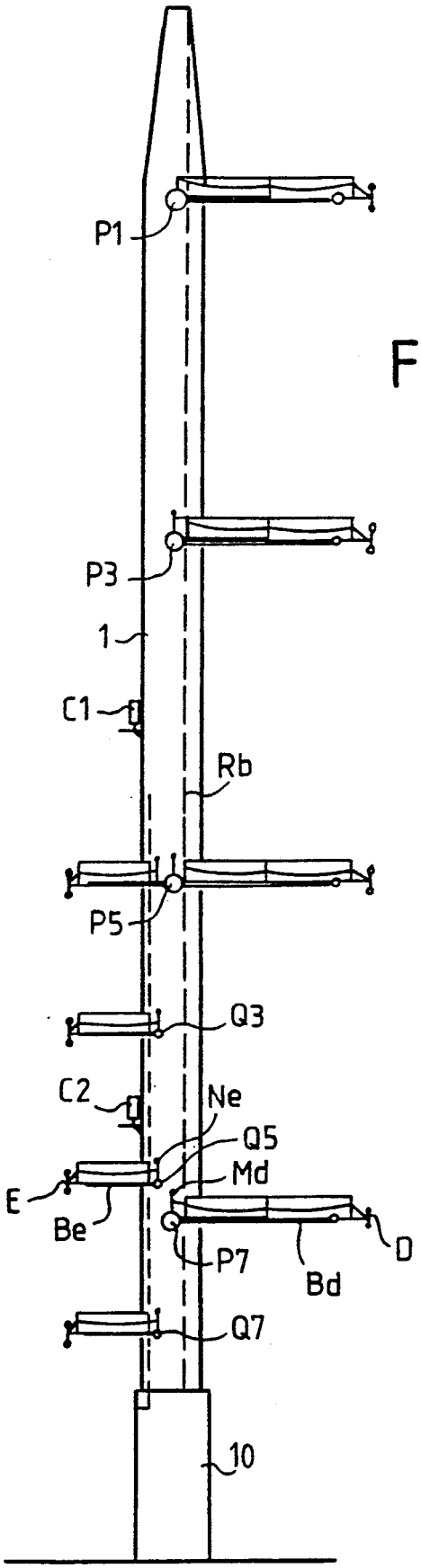
FIG. 2 shows a side view of the rotating antenna according to FIG. 1.

The rotating antenna that is shown in FIGS. 1 and 2 includes a central mast 1, with a base 10. The mast ends at 81 meters above the ground. In FIG. 1, only that part of the antenna located to the left of the mast 1 has been entirely represented because of problems related to the space taken up by the drawing and, above all, in order to highlight the appearance of certain elements of the antenna, on the right-hand side of the mast.

On either side of the mast, in the plane of FIG. 1 and perpendicularly to the plane of FIG. 2, horizontal beams P1–P8, Q3–Q8 are arranged in pairs. At one of their ends, these beams are hinged so as to rotate on a horizontal shaft, such as A, fixedly joined to the mast 1. Furthermore, they are secured to the mast 1 by stays such as H. The beams P1–P8 concern the array of half-wave dipoles of the lower-range antenna and the heights above the ground are 72, 54, 36 and 18 meters respectively for the beams P1–P2, P3–P4, P5–P6 and P7–P8. It must be noted that the beams P5–P6 also concern the array of half-wave dipoles of the higher-range antenna and the beams P5–P6, Q3–Q4, Q5–Q6, Q7–Q8 relating to the higher-range antenna are respectively at 36, 28, 20 and 12 meters from the ground.

On each of the beams P1–P8, Q3–Q8 there are fixed two rigid half-wave dipoles, such as the dipoles D and E, of the lower-range and/or higher-range antenna concerned by the beam. The distance between the four dipoles of one and the same array located on one and the same pair of beams is equal to the half wavelength at the center frequency of use of the antenna considered, i.e. it is equal to 18 meters for the lower-range antenna and 8 meters for the higher-range antenna. Furthermore, these four dipoles are arranged symmetrically with respect to the mast 1.

As can be seen from the front view according to FIG. 1 and the side view according to FIG. 2, the dipoles are arranged at one of the ends of a horizontal metallic arm such as the arm Bd for the dipole D and the arm Be for the dipole E. The end of the arm is fixedly joined to the beam as is the case with the arm Bd joined with the beam P7 and the arm Be joined with the beam Q5. The length of the metallic arms has been taken to be slightly greater than a quarter of the wavelength, at the working center frequency of the dipole borne by the arm considered.

The rotating antenna according to FIGS. 1 and 2 further includes two reflective planes Rb, Rh, formed by horizontal conductive wires, only a part of which has been shown in FIG. 1. In FIG. 2, the planes Rb and Rh are symbolized by two lines of dashes corresponding to the trace of these reflective planes in the plane of the figure. The wires of these reflective planes are fixed by one of their ends to the mast 1. Between the beams P1, P2 and P7, P8 on the one hand, and P3, P4 and Q7, Q8 on the other hand, the wires of the reflective planes are fixed, at their other end, to a lateral catenary, namely to a lateral cable such as the cables K2 and L1. This catenary is coupled to the ends of several beams. It is thus that the catenary K2 is fixed to the end of the beam P1, slides in an aperture made in the ends of the beams P3, P5, P7 and is stretched by a weight such as the weight Kp. In the same way, the catenary L1 is coupled to the beams P3, P5, Q3, Q5, Q7. Substantially parallel to these catenaries, vertical conductive cables, such as K4, mounted in the same way as the catenaries, complete the holding of the wires of the reflective plane. On either side of the beams of the lower-range antenna and beneath the beams of the higher-range antenna, the wires of the reflective planes are fixed, at their ends opposite to the mast, to a cable, such as the cables K1, K3, L2, which is held on the mast and, at its end opposite the mast, on the end of a beam, such as the beam P7 for the cable K3: spreaders formed by vertical metal bars, such as the bar K5 associated with the cable K3 and the bar L3 associated with the cable L2, enable the cable to be moved away from the beam associated with it. This manner of making the reflective planes differs from the conventional way of making them in that the sheet of wires is held not only at its top and bottom ends but also at intermediate levels by means of beams such as P3 and P5, as can be seen in FIG. 1.

FIGS. 1 and 2 also show holding bars, such as Md and Ne, which are standard vertical supports making it possible to hold the system of bifilary lines designed to provide for the supply of the dipoles.

FIG. 2 moreover shows two switch-over devices C1, C2 mounted on the mast 1 and designed respectively to control the supply of the half-wave dipoles of the lower-range antenna and higher-range antenna, this supply being provided by a line, not shown in the figures, which goes into the interior of the mast 1.

Figure 3:
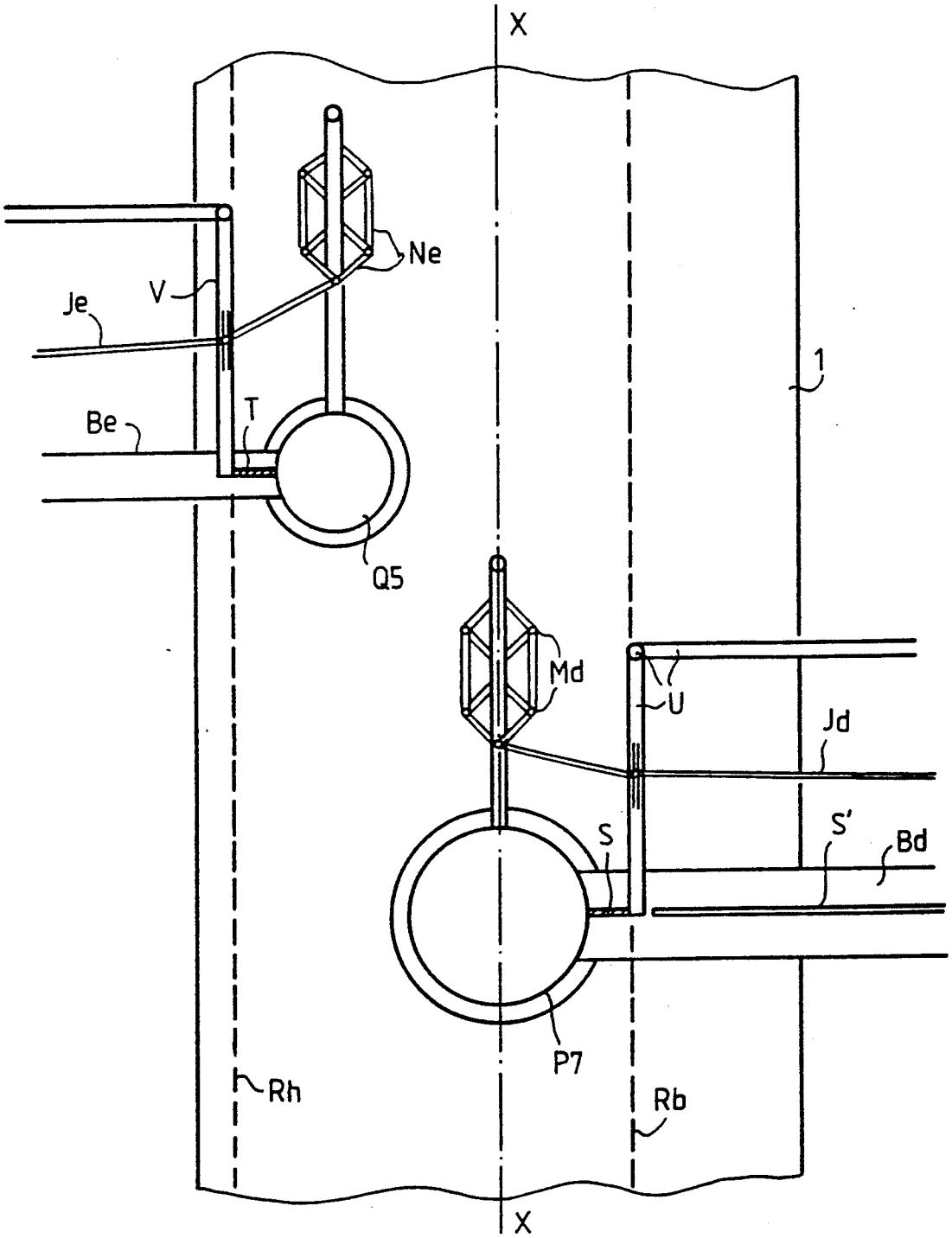
FIG. 3 shows a more detailed partial view of the rotating antenna according to FIGS. 1 and 2.

FIG. 3 is a partial view, more detailed than that of FIG. 2, located at the level of the beams Q5, P7. In this view, the geometrical axis of the mast has been shown with dots and dashes and the reflective curtains, Rb and Rh, have been shown with dashes. This view also shows:

the arms Bd, Be;

the bars Md, Ne, stepboards S, S' and T which run respectively along the beam P7, the arm Bd and the beam Q5 and enable a technician to carry out operations in the antenna, railings U and V which provide for the safety of the technician working on the antenna;

bifilary lines, such as Jd and Je, held by insulators on the vertical stanchions of the railings.

By way of comparison, antenna characteristics are given hereinafter. Of these antenna characteristics, the first correspond to the rotating antenna with half-wave rigid dipoles that has just been described, and the second ones correspond to a conventional rotating antenna designed and made by means of full-wave conductive wire dipoles to be switched over, like the rotating antenna described, either as a 4/4/0.5-6/7/9/11 MHz antenna or as a 4/4/0.75-13/14/17/21/26 MHz antenna:

extreme longitudinal wind speed (as defined by the French snow and wind regulations dated June 1980) at 10 m from the ground: 184 km/h for both rotating antennas;

maximum wind speed at 10 m from the ground at which the antenna can function: 100 km/h instead of 80 km/h with the standard antenna, maximum wind speed at 80 m from the ground at which the antenna can still function: 131 km/h instead of 105 km/h, total weight of rotating antenna: 2000 kN, 1800 kN, instant of overturning: 35,000 kN.m, 50,000 kN.m, space factor (width and height in meters): 74×81, 76×88, illuminated width (in working wavelength): 1.96, 1.55;

gain in decibels: (G+1)dB, GdB, giving a ratio of 1.26, transversal deformation under the effect of a 80 km/h wind at 10 m from the ground: none for the rigid dipoles and negligible for their reflective screen while, in the standard antenna, the conductive wire dipoles undergo major deformations and shifts, and the deformations of the curtains go up to several meters.

The present invention is not restricted to the example described. Thus, it can be applied also to the case where the rotating antenna is not a double antenna but a single antenna, namely one with only one array of rigid half-wave dipoles. It can be applied also to the case where the rotating antenna comprises three or more arrays of dipoles distributed, for example in the case of three arrays, around a support with a horizontal section in the shape of an equilateral triangle, each side of which is assigned to one array of rigid dipoles and to one reflector but, in this case, the arrays will no longer be supported by horizontal beams mechanically coupled to a central mast. It is also possible, within the framework of the invention, to make rotating antennas that have no devices for switching over rigid dipoles and, when these devices exist, they may be arranged differently from the case of the example described, for instance at the base of the mast.

And it should be noted that it is possible to make a rotating antenna with two arrays of half-wave rigid dipoles having only one reflective curtain. In the case of the example described, this amounts to having only the curtain Rb but increasing the number of conductive wires of this curtain wherever it acts as a reflector for higher-range dipoles. It should also be noted that a valuable example is the one where the rotating antenna to be made includes a central mast and an odd number of dipoles per horizontal line of dipoles. Indeed, in this case, the dipole of the middle of the line will be fixed not to one of the beams but directly to the central mast.

The present invention more particularly concerns rotating antennas designed to transmit in HF wave mode.

What is claimed is:

1. A rotating HF antenna for transmitting in a HF wave mode comprising:

a rotating support including:

a vertical central mast;

a plurality of substantially horizontal lateral beams, each of the beams having a free end and a further end for attachment to the central mast;

means for attaching each of the further ends of the lateral beams to the central mast;

a plurality of stays each having one end attached at one of the lateral beams and a further end attached to the central mast; and a plurality of substantially horizontal arms extending perpendicular to an associated one of the lateral beams, each arm having a first end attached to one of the plurality of lateral beams and a second end for attachment to an array of rigid, half-wave dipoles;

n arrays of rigid half-wave dipoles, wherein n is a whole number, each dipole of a given one of the n arrays of rigid, half-wave dipoles being individually connected to the second end of one of the plurality of substantially horizontal arms at a connection point, each dipole having at least one feeding point;

s vertical plane reflectors, formed by horizontal wires, each of the plane reflectors being associated with at least one of the n arrays of dipoles, wherein s is not more than n; and means for attaching the vertical plane reflectors to at least some of the lateral beams;

2. A rotating antenna according to claim 1, wherein each of the stays is arranged obliquely between an associated beam and the central mast.

3. A rotating antenna according to claim 1, further comprising means for attaching the vertical plane reflectors to the central mast.

4. A rotating antenna according to claim 1, wherein at least one of the n arrays of dipoles comprises horizontal lines of dipoles having an odd number of dipoles per line.

5. A rotating antenna according to claim 1, wherein the means for attaching each of the further ends of the lateral beams to the central mast includes a horizontal shaft, fixedly joined to the mast, about which an associated lateral beam is rotatable.

* * * * *